US005268042A

United States Patent [19]

Carlson

[11] Patent Number: 5,268,042

[45] Date of Patent: Dec. 7, 1993

[54] COMPOSITION AND PROCESS FOR FORMING IMPROVED, NON-CRACKING CHROMATE CONVERSION COATINGS

[75] Inventor: Lawrence R. Carlson, Waterford, Mich.

[73] Assignee: Henkel Corporation, Plymouth Meeting, Pa.

[21] Appl. No.: 723,008

[22] Filed: Jun. 28, 1991

[51] Int. Cl.[5] ..... C23C 22/37

[52] U.S. Cl. ..... 148/268

[58] Field of Search ..... 148/268

[56] References Cited

U.S. PATENT DOCUMENTS 3,347,713 10/1967 Lodeesen et al. ..... 148/6.2
3,391,031 7/1968 Russel et al. ..... 148/6.2

FOREIGN PATENT DOCUMENTS 656609 1/1965 Belgium .
1470884 3/1966 France .
8102749 10/1981 World Int. Prop. O. .

*Primary Examiner*—Sam Silverberg
*Attorney, Agent, or Firm*—Wayne C. Jaeschke; Norvell E. Wisdom, Jr.; Patrick J. Span

[57] ABSTRACT

Improved chromate conversion coating composition for forming non-cracking conversion coatings on aluminum or its alloys. Improvement is obtained by control of the total acid (TA) and free acid (FA) levels to a minimum of 6.0 and 3.5 respectively with a TA:FA ratio in the range of 1.5 to 2.5 by inclusion of aluminum nitrate in the composition.

15 Claims, No Drawings

COMPOSITION AND PROCESS FOR FORMING IMPROVED, NON-CRACKING CHROMATE CONVERSION COATINGS

BACKGROUND OF THE INVENTION

Field of the Invention

This invention relates to an improved composition and process for coating metal surfaces and more particularly to improved chromate conversion coatings for coating aluminum and aluminum alloy surfaces to provide improved corrosion resistant and paint bonding coatings on such surfaces. More particularly, the invention relates to aqueous acidic solutions which contain hexavalent chromium ions and fluoride ions which are improved by modifying the composition so as to provide a non-cracking corrosion resistant chromate coating on aluminum or aluminum alloy surfaces.

Statement of Related Art

Chemical conversion coatings on aluminum, such as chromium conversion coatings have been known for many years. In general, the chromate conversion coatings, commonly known as chromium oxide coatings, in contrast to chromium phosphate coatings, are applied from aqueous acidic solutions generally containing the hexavalent chromium containing ion and fluoride ions, providing a chemical film in coating weights on the order of from 5 mg/sq. ft. to about 200 mg/sq. ft.

In U.S. Pat. No. 3,347,713 there is described a chromate-fluoride aqueous acidic coating solution for aluminum which incorporates therein tungstate anions. In U.S. Pat. No. 3,391,031 there is described similar acidic chromate coating solutions which utilize activators other than tungsten, such as molybdenum, arsenic, vanadium and uranium. The patent lists a series of patents in the general area of solutions and methods for treating aluminum containing surfaces. As noted, the trend in development of the art has been to add to operational solutions additional anions or cations to achieve specific objectives.

In commercial operations of chromate-fluoride solutions for coating of aluminum, difficulties are encountered, one of which is cracking of the film on the surface of the aluminum which affects the corrosion resistance and paint receptivity of the coating. Such cracking is generally referred to as "mud cracking" as the appearance of the film under magnification, resembles the mud cracks appearing during drought periods, when ponds or other water bodies dry leaving a mud surface with random cracks in the surface of the dried mud.

DESCRIPTION OF THE INVENTION

In this description, except in the operating examples or where explicitly otherwise indicated, all numbers describing amounts of ingredients or reaction conditions are to be understood as modified by the word "about".

It has now been found that the "mud cracking" phenomenon of a chromate conversion coating can be minimized, if not entirely eliminated, by control of the total acid and free acid levels of the aqueous chromate-fluoride conversion coating solution, preferably without further introduction of other ions into the system. The present invention accordingly embodies an aqueous acidic chromate-fluoride conversion coating in which the total acid (TA) level is maintained at a level of at least 6.0 and the free acid (FA) level is maintained at a level of at least 3.5, with the ratio of TA:FA in the range of about 1.5 to about 2.5, and a $CrO_3$ concentration in the range of about 3.5 to about 5.5% preferably about 4–5, with about 4.5 being most preferred, where TA and FA and $CrO_3$ concentration are determined as described below.

With acidic coating solutions maintained as described in the present invention a chromate conversion coating results with substantial uniformity of thickness, enhanced adhesion to the aluminum metal and non-cracking, thereby providing greater corrosion protection. There also results increased adhesion with subsequent hydrophilic coatings. Most desirably the TA will be maintained at a level below 12.5, preferably in the range of about 10 to 12. The free acid level is most desirably maintained at a level below 8, preferably in the range of about 6.5–7.5. The TA:FA is preferred to be maintained at about 2, i.e. 1.7–2.1. The acid levels are determined by conventional titration methods on a 10 ml sample of the operating bath using 0.1N NaOH solution and are expressed in terms of milliliters of NaOH solution required to titrate to a specific endpoint. The titration for FA is carried out to a pH endpoint of 4.5 while the TA is carried out to a pH endpoint of 8.2. The $CrO_3$ concentration is determined by titration with ferrous sulfate and calculated in terms of percent by weight $CrO_3$.

In practice, the operating coating solutions are prepared from a more concentrated chromate solution by further dilution with water. One embodiment of this invention is the preparation and formulation of the concentrated solution from which the operating coating bath solution is made up or prepared. The final operating bath will generally be comprised of coating solutions such as described generally in U.S. Pat. No. 3,347,713 but which are improved by control of the TA and FA levels as described earlier above Accordingly the operating coating baths will generally follow the basic formulation described in said patent, the general formulation I thereof being as follows, the concentration being expressed in percent, weight/volume

| Solution component: | Concentration percent w./v. |
|---|---|
| $CrO_3$ | 0.05–1 |
| Fluoride ion (excess over Al complex) | 0.16–2.7 |
| Tungstate anion as tungsten | 0.01–0.4 |
| $Al(F)_x$ complex | 0.22–3.2 |

The hexavalent chromium ion may be supplied as chromic acid or one or more of the water soluble salts thereof, including the sodium, potassium or ammonium chromates or dichromates or admixtures thereof with chromic acid and its salts.

The fluoride ion may be supplied by any fluorine-containing compound which is capable of ionizing in the aqueous acidic solutions of this invention to provide the fluoride ion preferably by hydrofluoric acid, or fluoboric acid and the sodium, potassium and ammonium salts thereof. The aluminum fluoride ion may be supplied as such, by the introduction of Al compounds or may be formed in the bath as a complex from free aluminum and fluoride ion.

The tungsten ion may be supplied in the solution of this invention by adding thereto any ionizable tungsten compound such as tungstic acid, or its sodium or potassium or ammonium salts, which will give the tungsten anion when oxidized by chromic acid or the salts thereof.

The solutions of this invention may be used to form coatings on the surfaces of aluminum or aluminum alloys by immersion, dipping, brushing, or spraying the solution on the surface after conventional cleaning procedures have been employed to free the surface of oil, grease, oxide and the like.

The coating method broadly comprises using the selected form of application of the coating solution, such as immersion coating, to the aluminum or aluminum alloy surface to be coated, which surface may be pure aluminum or its alloys known to those skilled in the art. The temperature of the operating solution is preferably varied from room temperature to a temperature between 120° F. to about 160° F. Higher temperatures may be employed up to 180° F. or even the boiling point of the solution but no advantage is gained thereby at temperatures above 160° F.

The pH of the operating solution may be varied over a fairly wide range of acid pH, satisfactorily in the pH range of about 1.1 to about 2.3, but preferably in the range of about 1.6–2.1. In the coating operation a number of concurrent chemical reactions occur with changing ionic balances and imbalance of resulting concentrations and relative proportion of active ingredients, such as the chromate and fluoride ion concentration, which may affect coating ability. As noted in U.S. Pat. No. 3,347,713, one procedure employed has been to add acid to the operating solution, such as mineral acids like nitric or sulfuric acid or acids such as boric acid, which may be included in a replenisher solution used to maintain the operating solution in optimum coating condition.

The overall coating process generally comprises the steps of (a) cleaning the metal surfaces with conventional degreasers, alkaline or acid cleaning solutions (b) treating the surface with a deoxidizing or "desmutting" agent, (c) treatment with the chromate-fluoride conversion coating solution and (d) drying. The present invention relates to step (c) and the coating solutions, their formulation and use, the cleaning, deoxidizing or "desmutting" step and drying step being conventional and well known to those skilled in the art. In the process each of steps (a) through (c) are generally followed by a rinsing step.

The invention may be further illustrated by means of the following examples of the present invention in which all parts and percentages are by weight unless otherwise specified.

EXAMPLE I

This example will serve to illustrate the preparation and use of a chromate-fluoride conversion coating solution, and typical of a formulation employed in a commercial immersion coating process.

A typical makeup concentrate was prepared from the following components and amounts:

| Ingredient | Parts by Weight |
|---|---|
| Water (deionized) | 916.6 |
| Chromic Acid ($CrO_3$) | 46.0 |
| Boric Acid | 5.0 |
| Nitric Acid ($HNO_3$) 42° Be | 3.5 |
| HF (27.6 of 48%) | 18.9 |
| Sodium Tungstate | 10.0 |

-continued

| Ingredient | Parts by Weight |
|---|---|
| | 1000.0 |

The composition had a TA of 4.4 and FA of 2.7 for a ratio of TA:FA of 1.66 determined on a 3% v/v. solution based on a 10 ml aliquot for titrating purposes.

In forming an operating immersion bath solution for a chromate conversion bath for the treatment of aluminum or alloys thereof, 60 pounds (7 gallons) of the formulation prepared above is mixed per each 100 gallons of water to make up sufficient solution for filling the immersion tank to working level. The bath will have a $CrO_3$ concentration of about 0.3 % w/v within the general range of the 3,347,713 patent. After cleaning and deoxidizing in conventional manner the aluminum article is immersed for 10 seconds to 15 minutes at a temperature about 125°–150° F. after which it is rinsed with water not exceeding 135° F. and dried, preferably by force drying in an oven not to exceed 250° F., at which temperature drying will be completed in no more than 3 minutes. Longer times at lower temperatures may be employed.

Chromate-fluoride conversion coatings following the foregoing typical formulation and procedure will provide a chromate conversion coating on the aluminum which however under magnification illustrates "mud cracking" of the dried coating. Such cracks in the coating affects adversely the corrosion resistance by leaving interfacial substrate metal unprotected and adhesion of subsequent coatings to be applied.

The present invention modifies the typical coatings formulations above, generally by adding $Al(NO_3)_3$ and adjusting the boric acid and nitric acid, to adjust the TA level to a minimum of 6.0 and the FA value to a minimum of 3.5, and a TA to FA ratio above 1.5 to about 2.5 with the chromate concentration, at about the same level.

EXAMPLE II

A makeup concentration solution of the present invention was prepared using the ingredients and amounts below:

| Ingredient | Parts by Weight |
|---|---|
| Water (deionized) | 854.9 |
| Chromic Acid ($CrO_3$) | 46.0 |
| Boric Acid | 3.5 |
| ($HNO_3$) 42° Be | 22.0 |
| HF (48%) | 27.6 |
| Sodium Tungstate | 10.0 |
| Al $(NO_3)_3.9H_2O$ | 36.0 |
| | 1000.0 |

The TA and FA were determined as earlier described using 0.1N NaOH on a 3% v/v solution. The TA was 6.0 and the FA was 3.5 for a TA:FA ratio of 1.71.

EXAMPLE III

To ensure that the formulation in Example II above provided equal or better quality coatings as the typical product of Example I under substantially the same conditions, coating baths were prepared and 6 panels of each aluminum alloy 2024-T3 bare, 6061-T6, 7075-T6 and a 3003 series, each panel being treated in three stages as follows:

1. Degreasing stage using trichloroethane for 2 minutes at room temperature, followed by air drying.
2. Deoxidizing stage using a nitric acid solution, at room temperature, 5% w/v, for 2 minutes followed by a water rinse.
3. Coating stage with 3% v/v chromate coating of formulation Example II, having an FA of 3.8, a TA of 6.7 for a TA:FA of 1.76, coated for 3 minutes at 120° F., followed by air drying.

The coating weights were measured on each of the panels with the following results:

| Series | Panel | Panel Weight Before (g) | Panel Weight After (g) | Total Loss (mg) | Coating Weight mg/ft$^2$ |
|---|---|---|---|---|---|
| 3000 | 1 | 26.9588 | 26.9500 | 8.8 | 26.4 |
| (48 in$^2$) | 2 | 27.2521 | 27.2424 | 9.7 | 29.1 |
| | 3 | 27.3230 | 27.3122 | 10.8 | 32.4 |
| | 4 | 27.2839 | 27.2732 | 10.7 | 32.1 |
| | 5 | 27.4202 | 27.4088 | 11.4 | 34.2 |
| | 6 | 27.1007 | 27.0903 | 10.4 | 31.2 |
| 2024 | 7* | 34.4107 | 34.4028 | 7.9 | 23.7 |
| (48 in$^2$) | 8* | 34.0506 | 34.0444 | 6.2 | 18.6 |
| | 9* | 34.1968 | 34.1888 | 8.0 | 24.0 |
| | 10* | 35.9849 | 33.9769 | 8.0 | 24.0 |
| | 11* | 34.1145 | 34.1076 | 6.9 | 20.7 |
| | 12* | 33.8017 | 33.7930 | 8.7 | 26.1 |
| 6061 | 13 | 95.2900 | 95.2861 | 3.9 | 15.6 |
| (36 in$^2$) | 14 | 95.1330 | 95.1289 | 4.1 | 16.4 |
| | 15 | 95.1925 | 95.1882 | 4.3 | 17.2 |
| | 16 | 95.2114 | 95.2075 | 3.9 | 15.6 |
| | 17 | 95.1449 | 95.1390 | 5.9 | 23.6 |
| | 18 | 95.2539 | 95.2498 | 4.1 | 16.4 |
| 7075 | 19 | 25.4000 | 25.3918 | 8.2 | 32.8 |
| (36 in$^2$) | 20 | 25.4540 | 25.4459 | 8.1 | 34.2 |
| | 21 | 25.4176 | 25.4089 | 8.7 | 34.8 |
| | 22 | 25.4834 | 25.4746 | 8.8 | 35.2 |
| | 23 | 25.5315 | 25.5235 | 8.0 | 32.0 |
| | 24 | 25.4500 | 25.4413 | 8.7 | 34.8 |

*Coated at 115° F.; not 120° F.

Examination of coatings made in the manner described above confirmed that no cracking occured in the coatings. Thus, use of the composition of the present invention results in non-cracking of chromate conversion coatings, either complete elimination of cracking or substantial reduction thereof. Also, test results in the laboratory confirmed that the makeup solution of the present invention can be added to existing coating baths to maintain the total acid and free acid ratio to the desired level without requiring a change of the whole coating bath.

EXAMPLE IV

This example represents an optimum formulation to be recommended for commercial immersion bath chromate conversion coatings to reduce, or eliminate, macro and micro cracking. The formulation differs from Example III in that aluminum nitrate solution (60%) and HF (70%) is employed.

This formulation is as follows:

| Material | Parts by Weight |
|---|---|
| Water (DI) | 839.6 |
| Chromic Acid, Flake | 46.0 |
| Boric Acid | 3.5 |
| Nitric Acid, 42° Be | 22.0 |
| Hydrofluoric Acid, 70% | 18.9 |
| Sodium Tungstate | 10.0 |
| Aluminum Nitrate Solution (60%) | 60.0 |

-continued

| Material | Parts by Weight |
|---|---|
| | 1000.0 |

The product is a clear, orange-red liquid with a $CrO_3$ content which should be at 4.5% (++/−0.4%) determined by titration with 0.1N ferrous sulfate solution and calculated to $CrO_3$% concentration.

To prepare and make up an operating bath for conversion coating, 27 pounds (3 gallons) of the above formulation will be added for each 100 gallons of bath solution volume. This will provide for a chromic acid content of the bath in excess of 0.1%, about the optimum level for chromate conversion coating of aluminum or its alloys. The Free Acid (FA) content should be 6.9 (+/−0.7) points and the Total Acid (TA) should be at 11.3 the ml of 0.1N NaOH to titrate a 6% v/v solution to a pH endpoint of 4.5 for FA determination and 8.2 for TA determination. The ratio of TA:FA is within the range 1.5 to 2.5 and within the minimum requirement of 6.0 for TA and 3.5 for FA.

What is claimed is:

1. A method for forming a protective coating on the surface of aluminum or an alloy thereof comprising treating the surface with an aqueous acidic coating solution comprising:
   (A) an amount of hexavalent chromium ion corresponding stoichlometrically to from about 0.05 about 1 w/v % of $CrO_3$;
   (B) from about 0.22 to about 3.2 w/v % of $A(F)_x$ complex, said $Al(F)_x$ complex being formed in situ in the aqueous acidic coating solution, or in a concentrate from which said aqueous acidic coating solution is prepared by dilution with water, by additions of hydrofluoric acid and aluminum nitrate thereto;
   (C) from about 0.16 to about 2.7 w/v % of fluoride ion in excess over the amount in the $Al(F)_x$ complex; and
   (D) sufficient tungstate anion to correspond stoichlometrically to from about 0.01 to about 0.4 w/v % of tungsten, said aqueous acidic solution having a total acid level of at least 6.0 but less than 12.5 and a free acid level of at least 3.5 but less than 8 and a total acid to free acid ratio in the range of about 1.5 to 2.5.

2. A method as defined in claim 1 wherein said total acid level is in the range of about 10 to 12 and said free acid level is in the range of about 6.5 to 7.5.

3. A method as defined in claim 2 wherein said total acid level is about 11 and said free acid level is about 7.

4. A method as defined in claim 1, in which said aqueous acidic coating solution has a pH in the range of about 1.1 to about 2.3.

5. A method as defined in claim 1, in which said surface is treated with said aqueous acidic coating solution at a temperature up to about 160° F.

6. A method as defined in claim 1 in which said total acid and free acid levels, and the ratio thereof, are maintained by the addition of aluminum nitrate to the coating solution.

7. A method as defined in claim 1 wherein said aqueous acidic coating solution is prepared by dilution with water of a concentrate solution comprising an amount of hexevalent chromium ion corresponding stoichlometrically to from about 4–about 5% by weight of $CrO_3$ and comprising $Al(NO_3)_3$ in an amount effective to maintain the total acid and free acid levels and the ratio thereof as recited in claim 1.

8. A method as defined in claim 7 wherein said concentrate solution consists essentially of the composition

| | Parts by Weight |
|---|---|
| Water | 839.6 |
| Chromic Acid | 46.0 |
| Boric Acid | 3.5 |
| Nitric Acid, 42° Be | 22.0 |
| Hydrofluoric Acid, 70% | 18.9 |
| Sodium Tungstate | 10.0 |
| Aluminum Nitrate Solution (60%) | 60.0 |

9. A method as defined in claim 8 in which said aqueous acidic coating solution is prepared from said concentrate by diluting said concentrate with water in an amount of about 3 gallons of said concentrate for each 100 gallons of coating solution.

10. An aqueous chromium containing concentrate composition for forming aqueous acidic chromate conversion coating solutions by dilution with water, said concentrate comprising about 4–about 5% by weight $CrO_0$ and also comprising aluminum nitrate in an amount effective to provide upon dilution with water a aqueous acidic coating solution with a total acid level of at least 6.0 but below 12.5, a free acid level of at least 3.5 but below 8, and a total acid to free acid ratio in the range of about 1.5 to 2.5, said aqueous acidic coating solution comprising:

(A) an amount of hexavalent chromium ion corresponding stoichiometrically to from about 0.05--about 1 w/v % of $CrO_3$;

(B) from about 0.22 to about 3.2 w/v % of $Al(F)_x$ complex, said $Al(F)_x$ complex being formed in situ in said aqueous chromium containing concentrate composition by additions by hydrofluoric acid and aluminum nitrate thereto;

(C) from about 0.15 to about 2.7 w/v % of fluoride ion in excess over the amount in the $Al(F)_x$ complex; and (D) sufficient tungstate anion to correspond stoichiometrically to from about 0.01 to about 0.4 w/v % of tungsten.

11. An aqueous concentrate composition as defined in claim 10 in which said total acid level is in the range of about 10–12 and said free acid level is in the range of about 6.5 to 7.5.

12. A composition as defined in claim 11 in which said total acid level is about 11 and said free acid level is about 7.

13. A composition as defined in claim 10 in which said aqueous coating solution prepared from said concentrate has a pH in the range of about 1.1 to 2.3.

14. A concentrate composition as defined in claim 10, consisting essentially of the composition

| | Parts by Weight |
|---|---|
| Water | 839.6 |
| Chromic Acid | 46.0 |
| Boric Acid | 3.5 |
| Nitric Acid, 42° Be | 22.0 |
| Hydrofluoric Acid, 70% | 18.9 |
| Sodium Tungstate | 10.0 |
| Aluminum Nitrate Solution (60%) | 60.0 |

15. An aqueous acidic coating solution prepared from the concentrate defined in claim 14 by diluting said concentrate with water in an amount of about 3 gallons of said concentrate for each 100 gallons of coating solution.

* * * * *